United States Patent [19]

Soberman et al.

[11] 4,363,965

[45] Dec. 14, 1982

[54] DETECTION AND IDENTIFICATION METHOD EMPLOYING MOSSBAUER ISOTOPES

[75] Inventors: Robert K. Soberman; Kenneth Krevitz; Louis L. Pytlewski, all of Philadelphia, Pa.

[73] Assignee: The Franklin Institute, Philadelphia, Pa.

[21] Appl. No.: 193,723

[22] Filed: Oct. 3, 1980

[51] Int. Cl.[3] ..... G09K 3/00

[52] U.S. Cl. ..... 250/302

[58] Field of Search ..... 250/302, 303, 312, 260

[56] References Cited

U.S. PATENT DOCUMENTS

| | | | |
|---|---|---|---|
| 2,474,271 | 6/1949 | Meyer | 250/83.6 |
| 2,773,196 | 12/1956 | Hall | 250/106 |
| 2,983,354 | 5/1961 | Ember et al. | 194/4 |
| 3,130,315 | 4/1964 | Hamermesh et al. | 250/336 |
| 3,146,349 | 8/1964 | Jordan | 250/71.5 |
| 3,171,961 | 3/1965 | Yule | 250/83.3 |
| 3,255,352 | 3/1965 | Johnston | 250/83.3 |
| 3,257,558 | 6/1966 | Cook et al. | 250/360 |
| 3,295,651 | 1/1967 | Klackowski et al. | 194/4 |
| 3,308,296 | 3/1967 | Cowan et al. | 250/71.5 |
| 3,515,871 | 6/1970 | Johnson, Jr. et al. | 250/71.5 R |
| 3,654,464 | 4/1972 | Johnson, Jr. et al. | 250/71.5 R |
| 3,772,200 | 11/1973 | Livesay | 2 52/301.1 R |
| 3,780,294 | 12/1973 | Sowerby | 250/364 |
| 3,818,226 | 6/1974 | Strindehag | 250/302 |
| 4,019,053 | 4/1977 | Levine | 250/303 |

FOREIGN PATENT DOCUMENTS 1261790 2/1968 Fed. Rep. of Germany ..... 250/303

OTHER PUBLICATIONS

Coding Documents by Trace Element Inclusion, IBM Technical Disclosure Bulletin, vol. 11, No. 11, p. 1394 (Apr., 1969).

*Primary Examiner*—Bruce C. Anderson

*Attorney, Agent, or Firm*—Dann, Dorfman, Herrell and Skillman

[57] ABSTRACT

A detection/identification method for determining the presence of a Mossbauer isotope-containing taggant in a carrier material, e.g., explosives, weapons, currency, tax stamps, or identification documents. The detector includes a Mossbauer isotope-containing detecting substance that is identical to the taggant, and a sensing element responsive to the presence of the tagging substance in the carrier material, provided that the Mossbauer isotope of the tagging substance is in a state of resonance excitation and causes excitation of the Mossbauer isotope of the detecting substance. The sensing element is operatively associated with an indicator for indicating whether or not the sensing element has been actuated. The method is initiated by irradiating the carrier material while in detecting proximity to the detector, with radiation from a radioactive source comprising a Mossbauer isotope-containing substance which corresponds exactly to the taggant.

In the case of explosives, identification of the manufacturer, date of manufacture or type of explosive, may be made even after detonation.

17 Claims, 4 Drawing Figures

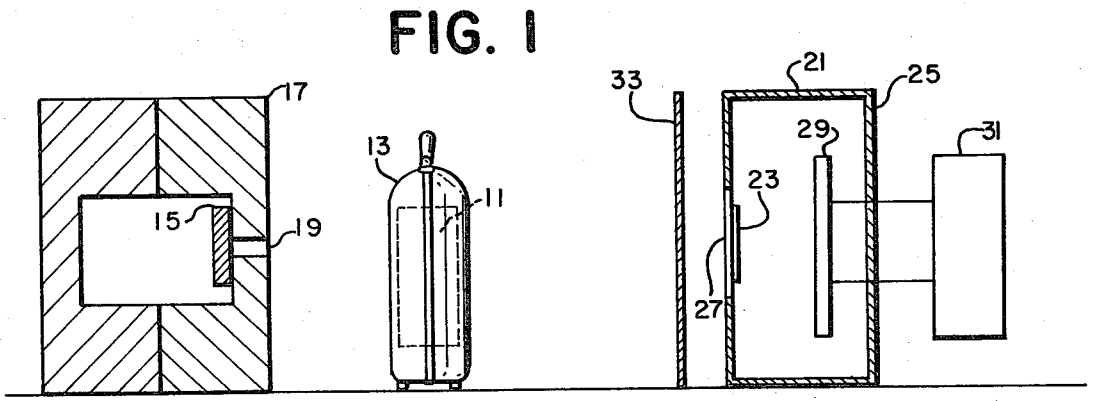
FIG. 1
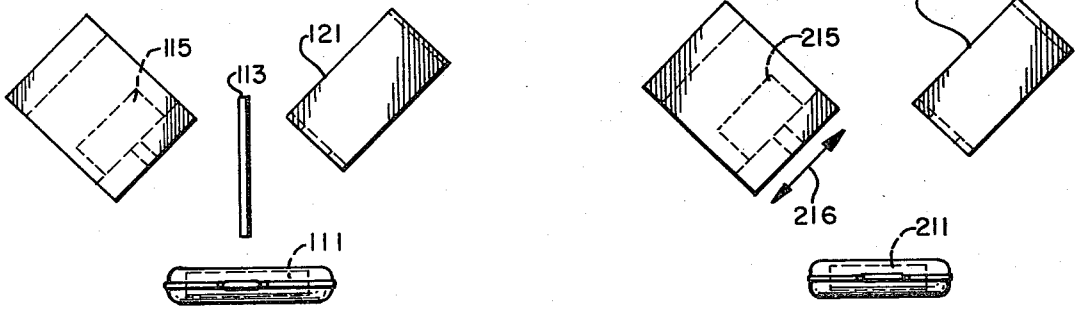
FIG. 2
FIG. 3
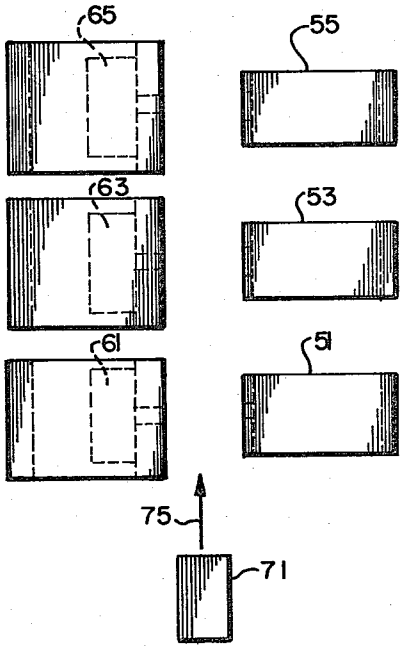
FIG. 4

DETECTION AND IDENTIFICATION METHOD EMPLOYING MOSSBAUER ISOTOPES

BACKGROUND OF THE INVENTION

The present invention pertains to a detection and identification method, and more particularly to detection and identification of a variety of materials by the use of Mossbauer isotopes. This invention is especially suited for the detection of hidden explosive materials, as well as for the identification of the source or type of explosive, even after detonation. The invention is also useful for the detection and/or authentication of currency, tax stamps, gambling chips, classified documents and the like.

Much of the research effort in the art of explosive detection and identification has been directed toward the development of nuclear techniques in which the explosive material has incorporated therein, during manufacture, a substance which either emits radiation spontaneously, or can be induced to emit radiation, and the emitted radiation is detected with a suitable detection device. Similar methods have been proposed for marking classified documents to prevent theft, and for determining the authenticity of currency and identification documents.

The radioactive elements or compounds normally used as taggants in these prior art methods are of rather limited utility. Radioactive taggants must be employed in very limited quantities in order to avoid potential health and safety hazards. This quantitative limitation on the taggant has several drawbacks. In the first place, a detection method involving the use of small quantities of radioactive taggant may be defeated altogether since the material carrying the taggant may be shielded from detection. Secondly, without the aid of specialized and expensive detection equipment, it is difficult to discriminate between radiation emanating from the material sought to be detected and other background radiation.

In order to overcome the problem of discriminating between radiation emitted from a radioactive taggant and background radiation, it has been proposed to use taggants which emit a plurality of substantially time-coincident and direction-correlated gamma rays, such as positron emitters $Na^{22}$ and $Al^{26}$. Since gamma radiation is very penetrating the tagged material cannot readily be shielded from detection. Moreover, by using such positron emitters as taggants, it is possible to use a small quantity of taggant and yet differentiate between the gamma rays emitted from the taggant and cosmic radiation or emissions from innocuous articles, such as luminescent clock dials, since the probability of time and direction coincidence from such background sources of radiation is very small. The principal drawback of this method is that it requires several detectors for operation. These detectors may include crystal, liquid or solid scintillator detectors, photomultipliers and attendant logic, coincidence and discriminator circuitry. The expense of such apparatus makes it uneconomic for many small businesses which might advantageously employ such a system, for example, for authenticating currency received from customers. In addition, there are a relatively limited number of radioactive elements available which are capable of emitting time coincident gamma rays, thus making impossible all but the simplest identification tagging of explosive materials with these elements. For this and other reasons, the prior art explosive detection methods employing such taggants are not adaptable to the post-detonation identification of explosive materials as to type or source.

Another prior art nuclear technique for the detection of explosives involves adding a high cross-section, non-radioactive neutron absorber, such as boron, to the explosive, and thereafter irradiating the explosive with a neutron source, whereupon the neutron absorber emits a gamma ray. A suitable detection device monitors either the emitted gamma rays or the depression in the neutron field caused by the presence of the explosive. A similar technique has been disclosed for checking the authenticity of identity documents, e.g., identification cards. Aside from requiring the use of relatively expensive detection apparatus, this method presents a very serious health and safety risk in that the biological tolerance level of living tissues for neutrons is very low. Further, since the number of available neutron absorbers is relatively few, this method cannot be used effectively for the post-detonation identification of explosives.

Although certain problems are encountered in practicing the above-described nuclear techniques for detecting concealed weapons, explosives, etc., those techniques have advantages over non-nuclear techniques such as metal detectors, x-ray detectors and the like, because the latter require human intervention by trained operators and are often triggered by objects which are actually harmless, causing unnecessary inconvenience for the owner of the article being examined. Moreover, as a practical matter, the chemical reaction of detonation precludes virtually all but nuclear taggants from being used when it is desired to effect both pre-explosion detection and post-explosion identification.

The above-described nuclear detection techniques have also been proposed for use in anti-counterfeiting methods. Nuclear detection has advantages over the various non-nuclear, anti-counterfeiting techniques of the prior art, such as the use of complex printing patterns, paper having characteristic water-marks, or fluorescent printing inks. These non-nuclear techniques can be duplicated by persons reasonably skilled in the art of printing and generally require only a minimal investment in equipment and materials for producing bogus currency. A truly effective anti-counterfeiting method is one that not only requires uncommon skill or training in order to circumvent, but also involves the use of extremely sophisticated and expensive equipment for marking the currency.

The detection/identification method of the present invention overcomes the aforementioned shortcomings of the prior art nuclear techniques for the detection of concealed weapons, explosives, classified documents, etc., and satisfies the above criteria for an effective anti-counterfeiting method.

SUMMARY OF THE INVENTION

In accordance with the present invention, there is provided a detection method in which the taggant for the material sought to be detected is a non-radioactive, inert substance comprising a Mossbauer isotope. This substance will sometimes be referred to hereinafter as "the Mossbauer taggant," or simply "the taggant". The Mossbauer taggant may be employed in elemental form or it may be chemically combined with other substances in the form of a chemical compound.

The practice of this detection method requires nuclear detector means, e.g. a photon or particle counting device, which includes a Mossbauer isotope-containing detecting substance that is identical to the Mossbauer taggant. The dector means also includes a suitable sensing means responsive to the presence of the tagging substance in the carrier material, provided that the Mossbauer isotope of the tagging substance is in a state of resonance excitation and causes excitation of the Mossbauer isotope of the detecting substance. The sensing means is operatively associated with suitable indicator means for indicating whether or not the sensing means has sensed radiation emitted from the excited Mossbauer isotope of the detecting substance. The carrier material is exposed to the detector means in position to activate the sensing means, and the Mossbauer isotope of the taggant is excited, if present in the carrier material, thereby indicating the presence or absence of the tagging substance in the carrier material.

As used herein, the expression "resonance excitation" means the absorption of a specific quantum of radiant energy by the Mossbauer isotope, which undergoes a transition from one of its energy states to one of higher energy, and the subsequent deexcitation to a lower energy state. In carrying out the present detection method, resonance excitation of the Mossbauer isotope of the detecting substance is accomplished by irradiating the carrier material with gamma radiation from a radioactive source, comprising a Mossbauer isotope containing substance corresponding to the taggant. When the taggant is present in the carrier material, the Mossbauer taggent is excited to a higher energy state and the excited Mossbauer isotope reemits resonance gamma radiation which excites the nucleus of the Mossbauer isotope of the detecting substance to a radiation emitting state and the sensing means senses the radiation emitted by the detecting substance. The radiation which is sensed by the sensing means may be either beta or gamma radiation.

It is also within the scope of the present invention to utilize Mossbauer isotopes in a method for providing identification information concerning particular objects. These may be one-of-a-kind objects, such as prototype weapons, or a group of objects, such as each unit of production of a particular explosive manufacturing plant. In this aspect of the invention, a predetermined number of inert identifier taggants are employed and a given one of the predetermined number of identifier taggants is incorporated in each of the objects or groups of objects sought to be identified. For example, each company that manufactures explosives would be assigned a different one of the predetermined number of identifier taggant to incorporate in its explosives and distinguish them from explosives of another manufacturer.

Each identifier taggant may be a substance comprising a single Mossbauer isotope, or a combination of Mossbauer isotopes. Thus, the identification taggant may be an element containing one Mossbauer isotope, or a compound containing two or more different Mossbauer isotopes. Alternatively, the identifier taggant may comprise two or more different compounds each containing a single Mossbauer isotope, the isotope in each compound being the same or different.

The identification method requires providing an index which correlates each identifier taggant in the aforementioned predetermined number of identifier taggants with identification information about the object or group of objects in which each identifier taggant is incorporated. The method further requires nuclear detector means, including Mossbauer isotope-containing detecting substances which are identical and equal in number to the predetermined number of identifier taggants. For example, the detector means may be a single detector of the type described above in connection with the detection method, including a group of Mossbauer isotope-containing detecting substances, each member of the group being identical to a different one of the predetermined number of identifier taggants, and the number of detecting substances in the group being equal to the predetermined number of identifier taggants.

Alternatively, the detector means may be a plurality of detectors, each detector including at least one Mossbauer isotope-containing detecting substance. When using a plurality of detectors, each detecting substance included in the detectors is identical to a different one of the predetermined number of identifier taggants and the total number of detecting substances in the plurality of detectors is equal to the predetermined number of identifier taggants. The maximum number of detectors which may be used in carrying out the identification method is equal to the predetermined number of identifier taggants, with one detecting substance, corresponding to a different one of the predetermined number of identifier taggants, being included in each detector.

The detector means also includes sensing means responsive to the presence of an identifier taggant in the object sought to be identified, provided that each Mossbauer isotope of that identifier taggant is in a state of resonance excitation and causes excitation of each Mossbauer isotope of the detecting substance to which it is identical. The sensing means has operatively associated therewith indicator means for indicating whether or not the sensing means has sensed radiation emitted from the detecting substance that is identical to the identifier taggant in the object under examination.

In practicing the identification method, an object sought to be identified is exposed to the detector means, and if the object contains an identifier taggant, the indicator means of the detector means containing the detecting substance that is identical to that identifier taggant will indicate that radiation emitted from that detecting substance has been sensed by the sensing means, whereupon identifying information about the object under examination is obtainable by reference to the index.

The sensing means is activated by irradiating a tagged object with gamma radiation from a series of radioactive sources, each source comprising a Mossbauer isotope-containing material that corresponds to one of the identifier taggants in the predetermined number of taggants, and thus to one of the detecting substances present in the detector means. Irradiation is carried out sequentially with each source in the series, the radiation emitted from each source having the exact energy required to cause resonance excitation in the nucleus of each Mossbauer isotope in the identifier taggant corresponding to that source, whereby gamma radiation is emitted from each excited Mossbauer isotope present in the identifier taggant when irradiated by its corresponding source. The gamma radiation emitted from the identifier taggant excites to a radiation-emitting-state the nucleus of each Mossbauer isotope of the detecting substance to which it is identical upon exposure to the detector means containing the identical detecting substance, and the radiation emitted from the detecting material is sensed by the sensing means.

The present invention may be used without fear of a health or safety hazard, since the radioactive sources employed in practicing the present detection and identification methods emit relatively low levels of radioactivity which may be as little as a millicurie. Moreover, the sources may be shielded readily for safety. While the method of the present invention is not recommended for the examination of humans, there is far less risk involved in the operation of this method than in prior art methods involving the use of a neutron source. Also, in comparison to prior art detection methods, implementation of the detection method of the present invention involves relatively little expense. The Mossbauer taggants are readily available and will not significantly increase the manufacturing cost of materials tagged therewith. Furthermore, the detection device employed in the present invention may be a single detector of rather simple construction which is relatively inexpensive to manufacture. However, more sophisticated detectors may be employed if increased sensitivity is desired. Another advantage of this invention is that it is extremely difficult to circumvent, since attempts to shield a material containing a Mossbauer isotope are easily detected.

A distinct advantage of the present invention is that the short range decay products, i.e., beta rays, emitted from each Mossbauer isotope nucleus present in the detecting substance provide a signal that is easily detectable even in the presence of scattered gamma radiation from various sources, including background radiation. In addition, the present detection method is capable of rapid and accurate examination of containers suspected of concealing objects or materials sought to be detected. Still another advantage of the present invention is that it may serve at once as a pre-detonation detection method and a post-detonation identification method for explosives.

The detection method of the present invention may also be used to determine the authenticity of currency, tax stamps, gambling chips, identification documents and the like, and thus provides a very effective anti-counterfeiting method. Indeed, the present invention could make the counterfeiting of currency virtually impossible if isotopically enriched forms of Mossbauer isotopes were incorporated as taggants in all newly printed bills. As in the case of detection, a single Mossbauer isotope-containing substance may be incorporated in each category of object or material desired to be authenticated, irrespective of its manufacturer.

The novel features and advantages of the present invention will be understood by those skilled in the art from a reading of the following detailed description in conjunction with the drawings, in which:

FIG. 1 is a schematic view in cross section of a preferred embodiment of the present invention showing the three basic elements of the detection method arranged for operation in the transmission mode;

FIG. 2 is a schematic representation of another embodiment of the invention showing the three basic elements of the detection method arranged for operation in the back scatter mode;

FIG. 3 is another schematic representation showing a variation of the embodiment illustrated in FIG. 2; and FIG. 4 is a schematic representation of a preferred arrangement for carrying out the identification method of the present invention.

The principle upon which the present invention operates is known as the Mossbauer effect, which may be defined as the recoil-free emission of a gamma particle by the nucleus of a radioactive isotope and the subsequent absorption of the particle by another atomic nucleus. The Mossbauer effect, which occurs in crystalline solids and glasses, but not in liquids, has been observed and measured in over 40 elements including readily available and relatively inexpensive elements such as potassium, tin, iron, zinc, iodine, and nickel. Naturally occurring iron, for example, contains only about two percent of the Mossbauer isotope $Fe^{57}$, yet this amount is sufficient to produce a significant absorption.

The Mossbauer effect occurs because the lattice arrangement of atoms in a solid follows the laws of quantum mechanics. Different chemical substances containing the gamma-emitting isotope will emit particles of different energies, since the electrons comprising the chemical bond in the vicinity of the isotope exert varying effects. The extreme sharpness of the gamma-ray transitions in Mossbauer isotopes makes it possible to measure precisely the extremely small perturbations of the nuclear levels due to their interaction with the surrounding electrons.

In a conventional Mossbauer spectrometer, also known as a gamma-ray resonance spectrometer, the radioactive source is mounted on a velocity transducer which imparts a smoothly varying motion of up to a maximum of several centimeters per second to the source. The source is moved in relation to the material to be examined, which is generally referred to as the absorber. Since the absorber is held stationary, a Doppler effect is produced between the source and the absorber. Some of the incident gamma rays from the source are absorbed and reemitted by the absorber in all directions, while other gamma rays traverse the absorber and are registered in a detector which causes one or more pulses to be stored in a multichannel analyzer. The electronics are so arranged that the location in the multichannel analyzer where the transmitted pulses are stored is synchronized with the magnitude of the relative motion of source and absorber. By contrast to conventional techniques employing the Mossbauer effect, the operation of the present invention, which will be described more fully below, is such that no apparatus is required for producing a Doppler effect between any of the elements used herein.

Although the Mossbauer effect has been applied in such diverse fields as archeology, geology (e.g. borehole prospecting), theoretical physics, chemical kinetics and biology, and has even been intimated in U.S. Pat. No. 3,146,349 as being useful in explosive detection, it is not believed that the Mossbauer effect has ever before been applied as in the detection/identification method specifically described hereinbelow.

Referring now to FIG. 1, it will be seen that the present method essentially involves the interplay of three elements. The first element is a carrier material, which may take various forms, but is illustrated in FIG. 1 as an explosive material 11 which is concealed in a suitcase 13. The carrier material sought to be detected has incorporated therein a Mossbauer isotope-containing taggant. The second element is a radioactive source of gamma radiation 15. The source is surrounded by a suitable shield designated 17, which may be a lead block. The shield is provided with an opening 19 of sufficient size to permit the passage of gamma-rays therethrough. The third element is a detector 21 including a Mossbauer isotope-containing detecting substance 23 which is identical in chemical form to that present in the taggant. As used herein the term "identical" is intended to signify that the electronic environment of the Mossbauer isotopes in the taggant and the detecting substance are the same. This may be accomplished by employing the same chemical form of Mossbauer isotope in the taggant and detector. For example, when $Fe_2O_3$ containing $Fe^{57}$ is used as the Mossbauer taggant, the requisite matching must be achieved by using $Fe_2O_3$ containing $Fe^{57}$ in the detector. The detector housing 25 is provided with a window 27 to permit external gamma radiation to impinge upon the detecting substance 23, which may be applied as a film to the interior surface of window 27 by techniques well known to those skilled in the art. Detector 21 also contains a suitable sensing means 29, such as the anode wire of a gas proportional detector, an electron multiplier, or the like, which is sensitive to the emission of various forms of radiation from the detecting substance. It is preferable to sense beta radiation emitted from the detecting substance. This may be accomplished without interference from background radiation because window 27 serves to prevent external beta rays from entering the detector. A shield 33, such as aluminum foil, which allows the passage of gamma rays, but absorbs beta rays, may be positioned adjacent to the window of the detector as shown in FIG. 1 in order to insure that no external low energy beta rays enter the detector. Shield 33 may be mounted directly over the window of the detector if desired.

The sensing means is operatively associated with indicator means 31 which indicates whether or not the sensing means has sensed radiation emitted from the detecting substance. Although a single- or multi-channel analyzer is a suitable indicator means, the sensing means may, if desired, be connected to a less sophisticated indicator means such as a conventional alarm system.

The preferred Mossbauer isotope-containing taggants for practicing the present invention are those having atoms tightly bound in a crystalline lattice, which emit gamma-rays having low energy, i.e., less than about 100 keV. These gamma rays result from a transition from the first excited nuclear level to the ground level. In practice, it has been found that an inert compound including $Fe^{57}$ provides satisfactory results. Isotopically enriched forms of the taggant may also be used, and are recommended for authenticating currency and the like, in order to make duplication by would-be conterfeiters practically impossible.

In accordance with the present invention, the chemical form of the Mossbauer taggant (which corresponds to the absorber in a conventional Mossbauer spectrometer) is pre-determined. This makes it possible to select as the radioactive source a material which corresponds to the Mossbauer taggant. The radioactive source material must emit gamma radiation having the exact energy required to cause resonance excitation in the Mossbauer isotope of the taggant. A suitable radioactive source may be obtained by irradiating the Mossbauer taggant in an accelerator. For example, in the case of a taggant containing $Fe^{57}$, the corresponding source would contain $Co^{57}$. As is well known, the decay scheme of $Co^{57}$ terminates in $Fe^{57}$ with transitions from the first excited nuclear level to the ground level and gamma-ray emission (14.4 keV) occurring spontaneously during the process. The irradiated Mossbauer isotope of the taggant, in turn, will emit gamma radiation having an energy level identical to that emitted by the source, which is the exact energy required to cause resonance excitation in the Mossbauer isotope of the detecting substance. Since the radioactive source and the Mossbauer taggant emit radiation of the exact same energy, no apparatus is required for producing a Doppler effect between the source and the object under examination. Consequently, the method of the present invention may be carried out more quickly, simply and cheaply, than would be the case if a conventional Mossbauer spectrometer were used. In accordance with the present invention, therefore, the radioactive source emits gamma radiation having a constant energy level, instead of radiation having varying energy levels, as in a conventional Mossbauer spectrometer.

Almost any nuclear detection device may be employed in practicing the present method, such as gas proportional detectors, electron multiplier detectors, semiconductor detectors and scintillation detectors. The only requirement of the detector is that it must include a Mossbauer isotope-containing detecting substance identical in chemical form to the Mossbauer taggant.

A suitable detection device may be constructed in accordance with the teachings of Yagnik et al., 114 Nuclear Instruments and Methods 1 (1974), or Swanson et al., 41 Journal of Applied Physics 3155 (1970), the disclosures of which are incorporated herein by reference. The gas proportional detectors described in these publications may be provided with any desired Mossbauer isotope-containing detecting substance, which is mounted in the sensitive volume behind the window of the device.

Before commencing operation of the detection method in the transmission mode, as illustrated in FIG. 1, the detector is exposed to the source in the presence of an untagged carrier material in order to establish a standard reading on the detector. Since the untagged carrier material will be, in effect, transparent to the gramma radiation emitted from the source, substantially all of this radiation will be transmitted through the untagged carrier causing resonance excitation of the nucleus of the Mossbauer isotope in the detecting substance. The excited nucleus will emit a base level of radiation, which activates the sensing means and is indicated by the indicating means, thus providing a standard for subsequent operation of the detector. Thereafter, when a tagged carrier material is exposed to the detector and irradiated with gamma radiation from the radioactive source, the gamma radiation will be absorbed by the nucleus of the Mossbauer istope in the taggant, which will reemit a fraction of the absorbed gamma radiation. In the case of a $Fe^{57}$-containing Mossbauer taggant, for example, the 14.4 keV level in the nucleus undergoes transition to the ground state by reemission of a 14.4 keV gamma ray 10% of the time, or by emission of a 7.2 keV conversion electrons 90% of the time. As mentioned previously, electrons (beta radiation) have insufficient energy to enter the detector. In this case, therefore, a lower amount of gamma radiation will impinge on the Mossbauer isotope of the detecting substance when the Mossbauer isotope is present in the carrier material. If, however, the gamma radiation emitted from the source is collimated, and the source, detector, and carrier material are arranged such that the collimated source radiation is out of alignment with the window of the detector, the base level of radiation approaches zero, thereby facilitating sensing of the radiation emitted from the detecting substance when a tagged carrier material is under investigation. Thus, during operation of the method, the detector detects the amount by which the radiation emitted from the detecting substance during the aforesaid irradiating step differs from the base level of radiation. In this connection, it should be understood that Mossbauer isotope taggants are far more effective in absorbing gamma radiation than are other substances having nuclear radii of comparable size.

In its simplest form, the detection method may be practiced with a single source and a single detector arranged on opposite sides of a conveyor, for example, with the carrier material passing between the source and detector on the conveyor. The source intensity, concentration of taggant, isotopic enrichment of the taggant, and placement of the detector may be varied independently to reduce the time necessary for detection. On the average, a suspect container may be examined thoroughly in as little as 5 to 10 seconds. Thus, assuming that all newly manufactured explosives and weapons were required to be tagged with a Mossbauer taggant, the present invention could be used to detect such items in a safe, effective and efficient manner. The apparatus required to practice the detection method of the present invention could readily be installed at airports, courts, and other sites where detection systems are presently in use.

Attempts to shield materials sought to be detected would be readily observable, since the presence of shielding material, such as lead, in the carrier material would reduce the amount of radiation passing through the carrier material even more so than would the presence of a Mossbauer taggant therein.

The detection method of the present invention may also be carried out in one of the back scatter arrangements shown schematically in FIGS. 2 and 3 wherein the source and the detector are located on the same side of the carrier material, which is indicated as 111 in FIG. 2 and 211 in FIG. 3. In the contrast to the arrangement of elements in the transmission mode, wherein the radiation paths from source to carrier, and from carrier to detector are essentially in alignment, different radiation paths are present in the back scatter mode between the carrier and the source and between the carrier and the detector. In the embodiment shown in FIG. 2, a suitable shield 113 made of lead, for example, is interposed between the source 115 and the detector 121, in order to prevent radiation emitted by the source from directly exciting the Mossbauer isotope of the detecting substance. As shown in FIG. 3, instead of employing a shield to prevent the source from directly exciting the Mossbauer isotope of the detecting substance, source 215 may be made to oscillate, as indicated by the double-headed arrow 216, producing a Doppler effect between it and detector 221. The Doppler effect will alter the energy level of the radiation emitted from the source sufficiently that it will not excite the Mossbauer isotope of the detecting substance. If no precautions are taken to prevent the source from directly exciting the Mossbauer isotope of the detecting substance, the effect of the gamma radiation emitted from the Mossbauer taggant would be masked. In practicing the present invention, it is also possible to employ a combination of transmission and back resonance arrangements.

A typical arrangement for carrying out the identification method of the present invention is illustrated in FIG. 4. This arrangement involves a series of detectors, 51, 53 and 55, like the one described hereinabove, containing a detecting substance and sensing means (not shown), the latter being connected to a suitable indicator means (not shown). Each detector includes a different Mossbauer isotope-containing detecting material that is identical to a given one of the Mossbauer isotope-containing identifier taggant used in the identification scheme. Each detector is matched to a particular radioactive source 61, 63 and 65 comprising a Mossbauer isotope which corresponds to the detecting substance, and thus to one of the identifier taggants. Three detectors and sources are depicted in FIG. 4 for the purpose of illustration only. As indicated above, a single detector including detecting substances identical to each of the identifier taggants used in the identification scheme may be employed rather than a plurality of detectors. When a single detector is employed, means must be provided to match the detector sequentially to each source in the series of radioactive sources.

In order to obtain information about an object which has been tagged for identification in accordance with the present invention, an index must be provided correlating each identifier taggant in the predetermined number of identifier taggants with identification information about the objects or groups of objects in which the taggants are incorporated. In most instances, this information will relate to the identity of the manufacturer of the object. Other information, such as the composition and/or date of manufacture of the object may also be included in the index.

In carrying out the identification method, as illustrated in FIG. 4, the tagged object 71 sought to be identified is exposed sequentially to each detector in the series and its associated source until one indicator means indicates that the sensing means of one of the detectors has sensed radiation emitted from its detecting substance. The direction of travel of object 71 is shown by arrow 75 in FIG. 4. The radiation emitted from each source has the exact energy required to cause resonance excitation in the nucleus of each Mossbauer isotope in the identifier taggant corresponding to that source, assuming that the identifier taggant is present in the object, whereby gamma radiation is emitted from each excited Mossbauer isotope present in the identifier taggant when irradiated by its corresponding source. The gamma radiation emitted from the identifier taggant excites the nucleus of each Mossbauer isotope of the detecting substance to which it is identical to a radiation emitting state, and the radiation emitted from the detecting substance is sensed by the sensing means. Since the detecting substance in the activated detector is known and is identical to the identifier taggant, identifying information about the object under examination is readily obtainable by reference to the index.

Explosives tagged for identification in accordance with the present invention are identifiable even after detonation of the explosives, since the taggants are inert and are recoverable from the debris at the blast site.

If desired, both an identifier taggant and a detection taggant may be incorporated in the same objects, such as explosives and weapons, during the manufacturing process. In the case of explosives, for example, while a different identifier taggant would be used by each manufacturer, a single detection taggant would be used in all of the various types of explosives.

It is understood that governmental action in the form of legislation requiring the incorporation of Mossbauer isotope-containing taggants in explosives and weapons would be required in order for the benefits of the present invention to be realized. The government itself would have to adopt the method in connection with the printing of currency and tax stamps. Moreover, a regulatory scheme would have to be established setting out the particular detection taggants used in each category of product sought to be detected and the particular identifier taggant to be used by each manufacturer making such products. While the aforementioned preconditions to widespread use of the present invention may be regarded as drawbacks, when one considers the serious problems that can be solved by the present invention, e.g., reduction of the threat of terrorism and prevention of counterfeiting, it is self-evident that governmental adoption and use of the present invention is warranted.

From the foregoing description, it should be appreciated that the present invention possesses numerous advantages over prior art detection/identification methods. The method of the present invention utilizes taggants which cannot readily be shielded without being detected, and the radiation emitted from the taggants is easily distinguishable from background radiation. Furthermore, the method permits rapid and accurate examination of containers suspected of concealing materials sought to be detected, while employing safe levels of radiation, and a detector of relatively simple construction. In addition, the same principle underlying the detection method can be applied to obtain identification information about the material sought to be detected.

Obviously numerous modifications and variations of the present invention are possible in light of the above teachings. It is therefore to be understood that, within the spirit and scope of the appended claims, the invention may be practiced otherwise then as specifically described.

We claim:

1. A method for indicating the presence of a non-radioactive, inert tagging substance in a carrier material, said tagging substance comprising a Mossbauer isotope, the method comprising the steps of:

(a) providing nuclear detector means including a Mossbauer isotope-containing detecting substance, which is identical to the tagging substance, and sensing means responsive to the presence of said tagging substance in said carrier material, provided that the Mossbauer isotope of said tagging substance is in a state of resonance excitation and causes excitation of the Mossbauer isotope of said detecting substance, said sensing means being operatively associated with indicator means for indicating whether or not said sensing means has sensed radiation emitted from the excited Mossbauer isotope of said detecting substance;

(b) exposing said carrier material to said detector in position to activate said sensing means; and (c) irradiating said carrier material with radiation causing resonance excitation of the Mossbauer isotope of said tagging substance, if present in said carrier material, to thereby indicate the presence or absence of said tagging substance in said carrier material.

2. The method claimed in claim 1 wherein said irradiating step includes irradiating the carrier material with gamma radiation from a radioactive source comprising a Mossbauer isotope-containing substance which corresponds to the tagging substance, said radiation having the exact energy required to cause resonance excitation in the Mossbauer isotope of the tagging substance, if present in the carrier material, whereby gamma radiation is emitted from the excited Mossbauer isotope of the tagging substance, and excites the nucleus of the Mossbauer isotope of the detecting substance to a radiation emitting state, the radiation emitted by said detecting substance being sensed by said sensing means.

3. The method claimed in claim 2 wherein the sensing means is activated by radiation of beta rays from said detecting substance.

4. The method claimed in claim 2 wherein the sensing means is activated by radiation of gamma rays from said detecting substance.

5. The method claimed in claim 2 wherein the radioactive source provides gamma radiation having a constant energy level.

6. The method claimed in claim 2 wherein the radioactive source and the detector are located on opposite sides of the carrier material, said source, detector and carrier material being out of direct alignment.

7. The method claimed in claim 2 wherein prior to said irradiating step an untagged carrier material is interposed between said detector and said source and gamma radiation from said source is passed through said untagged carrier material, the indicator means indicating a base level of radiation emitted by the nucleus of the Mossbauer isotope of the detecting substance as a result of exposure to said source radiation, and thereafter the indicator means indicates the amount by which the radiation emitted from said detecting substance differs from said base level of radiation during said irradiating step.

8. The method claimed in claim 2 wherein the radioactive source and the detector are located on the same side of the carrier material so as to provide different paths of radiation between the carrier and the source, and between the carrier and the detector.

9. The method claimed in claim 8 wherein a radiation shield is interposed in the path between the radioactive source and the detector, out of the path between said radioactive source and said carrier material, and out of the path between said carrier material and said detector.

10. The method claimed in claim 8 wherein motion is effected between the radioactive source and the detector to utilize the Doppler effect to prevent gamma radiation emitted by the source from directly exciting the nucleus of the Mossbauer isotope of the detecting substance included in the detector.

11. A method for detecting the presence or absence of an explosive material in a container, the method comprising:

(a) incorporating in the explosive material a non-radioactive, inert tagging substance comprising a Mossbauer isotope;

(b) providing nuclear detector means including a Mossbauer isotope-containing detecting substance which is identical to the tagging substance, and sensing means responsive to the presence of said tagging substance in the carrier material, provided that the Mossbauer isotope of said tagging substance is in a state of resonance excitation and causes excitation of the Mossbauer isotope of said detecting substance, said sensing means being operatively associated with indicator means for indicating whether or not said sensing means has sensed radiation emitted from the excited Mossbauer isotope of said detecting substance;

(c) exposing said container to said detector in position to activate said sensing means; and (d) irradiating said container with gamma radiation from a radioactive source comprising a Mossbauer isotope-containing substance which corresponds to the tagging substance, said radiation having the exact energy required to cause resonance excitation in the Mossbauer isotope of the tagging substance, if present in said container, whereby gamma radiation is emitted from the excited Mossbauer isotope of said tagging substance; excites the nucleus of the Mossbauer isotope in the detecting substance to a radiation emitting state, the radiation emitted by said detecting substance being sensed by said sensing means, thereby indicating the presence or absence of said explosive material in said container.

12. The method claimed in claim 11 wherein the sensing means is activated by radiation of beta rays from said detecting substance.

13. The method claimed in claim 11 wherein the sensing means is activated by radiation of gamma rays from said detecting substance.

14. A method for obtaining identifying information about an object or a group of objects, the method comprising:

(a) incorporating in each said object or group of objects a given one of a predetermined number of inert identifier taggants embodying an isotope selected from the group consisting of a Mossbauer isotope and a combination of Mossbauer isotopes, no two identifier taggants in said predetermined number being the same;

(b) providing an index correlating each identifier taggant in said predetermined number with identifying information about the object or group of objects in which each taggant is incorporated;

(c) providing nuclear detector means, including Mossbauer isotope-containing detecting substances, which are identical and equal in number to the predetermined number of identifier taggants, and sensing means responsive to the presence of an identifier taggant in one of said objects or in a member of said group of objects, provided that each Mossbauer isotope of said identifier taggant is in a state of resonance excitation and causes excitation of each Mossbauer isotope of said detecting substance to which it is identical, said sensing means being operatively associated with indicator means for indicating whether or not said sensing means has sensed radiation emitted from each Mossbauer isotope of said identical detecting substance;

(d) exposing an object containing an identifier taggant to said detector means in position to activate said sensing means whereby the indicator means of the detector means containing the detecting substance that is identical to said identifier taggant indicates that radiation emitted from said identical detecting substance has been sensed by said sensing means, and identifying information about said object is obtainable from said index.

15. The method claimed in claim 14 wherein said detector means is a single detector including a group of Mossbauer-isotope-containing detecting substances, each member of said group being identical to a different one of said predetermined number of identifier taggants, and the number of detecting substances in said group being equal to said predetermined number of identifier taggants.

16. The method claimed in claim 14 wherein said detector means comprises a plurality of detectors, each detector including at least one Mossbauer-isotope-containing detecting substance, each detecting substance included in said plurality of detectors being identical to a different of the predetermined number of identifier taggants, the total number of detecting substances in said plurality of detectors being equal to the predetermined number of identifier taggants.

17. The method claimed in claim 14 wherein said sensing means is activated by:

(a) providing a series of radioactive sources, each source comprising a Mossbauer isotope-containing material corresponding to one of the identifier taggants in the predetermined number of identifier taggants; and (b) irradiating said object sequentially with gamma radiation from said sources in said series, the radiation emitted from each source having the exact energy required to cause resonance excitation in the nucleus of each Mossbauer isotope in its corresponding identifier taggant, whereby gamma radiation is emitted from each excited Mossbauer isotope present in the identifier taggant when irradiated by its corresponding source, and excites to a radiation emitting state the nucleus of each Mossbauer isotope of the detecting substance to which the identifier taggant is identical upon exposure to the detector means containing said detecting substance, the radiation emitted from the detecting substance being sensed by said sensing means.

* * * * *